US005552867A

United States Patent [19]

Sekino et al.

[11] Patent Number: 5,552,867

[45] Date of Patent: Sep. 3, 1996

[54] TONER REGULATING BLADE HAVING A BEVELLED EDGE

[75] Inventors: Hitoshi Sekino; Hirokatsu Shimada; Yasutsugu Takesue; Akihiro Kawasaki; Hiroshi Toda, all of Toyokawa, Japan

[73] Assignee: Minolta Co., Ltd., Osaka, Japan

[21] Appl. No.: 295,046

[22] Filed: Aug. 26, 1994

[30] Foreign Application Priority Data

Aug. 27, 1993 [JP] Japan ..... 5-212625
Feb. 28, 1994 [JP] Japan ..... 6-029503

[51] Int. Cl.[6] ..... G03G 15/08

[52] U.S. Cl. ..... 355/245; 355/253

[58] Field of Search ..... 355/245, 246, 355/253

[56] References Cited

U.S. PATENT DOCUMENTS 4,538,898 9/1985 Kanno et al. ..... 355/253 X
4,575,220 3/1986 Sakamoto et al. ..... 355/253
4,760,422 7/1988 Seimiya et al. ..... 355/253
4,796,561 1/1989 Takano et al. ..... 355/253 X
4,908,291 3/1990 Fuma et al. ..... 118/657
4,920,916 5/1990 Mizuno et al. ..... 355/245 X

FOREIGN PATENT DOCUMENTS 63-85654 4/1988 Japan .

*Primary Examiner*—Nestor R. Ramirez
*Attorney, Agent, or Firm*—Burns, Doane, Swecker & Mathis, L.L.P.

[57] ABSTRACT

An electrostatic latent image developing device includes a rotatable developing sleeve for providing an electrostatic latent image formed on a photoreceptor with a toner so as to develop the latent image into a visual image, and a toner regulating blade which contacts at one surface with the developing sleeve so that the toner is regulated and then formed into a thin layer. The toner regulating blade has, in a surface confronting the toner bearing member, a bevelled portion which forms a wedge shaped space in a upstream side of a contact region of the blade and the developing sleeve with respect to a direction of a movement of the developing sleeve. Further, the toner regulating blade has chamfered portions in the bevelled portion at both sides thereof. Therefore, the sleeve bears a toner thin layer having a constant density.

15 Claims, 9 Drawing Sheets

TONER REGULATING BLADE HAVING A BEVELLED EDGE

BACKGROUND OF THE INVENTION

1. Field of the invention

The present invention relates to an electrostatic latent image developing device. Specifically, the present invention relates to a developing device in which a toner regulating blade disposed adjacent a toner bearing member, such as developing roller, is held in contact with the toner bearing member so as to form a thin toner layer of toner on the toner bearing member as the latter moves past the blade, and the toner regulating blade used therein.

2. Background of the invention

There has been known an electrostatic latent image developing device employed in an electrophotogaphic image forming apparatus for developing an electrostatic latent image into a visible powder image using developing material. This known apparatus includes a toner bearing member such as, for example, a developer roller for providing a photosensitive member with a toner or a toner supply roller for providing the developer roller with the toner, and a toner regulating blade in a form of a rectangular plate which is so arranged as to contact at one surface thereof with the toner bearing member. According to the developing device, a toner retained on the toner bearing member is transported by the movement thereof and is regulated and then formed into a thin toner-layer at a region where the blade contacts the toner bearing member.

However, even a slight misdisposition of the blade will result in large variance of the amount of toner to be retained on the toner bearing member. Therefore, quite a long time is needed for a correct installation or disposition of the blade in order to make the toner bearing member retain a specific amount of toner. Also, a force of contact of the blade against the toner bearing member on both sides thereof are lower than that of a remaining region thereof so that density of toner layer per unit area on both sides are higher than that of the remaining region, which results in an uneven density of resultant image.

SUMMARY OF THE INVENTION

It is therefore an object of the present invention to provide an improved electrostatic latent image developing device, and an toner regulating blade employed therein which is capable of forming a thin toner-layer having an uniform density on an incremental portions of a toner bearing member moving past a contact region where the blade contacts therewith.

To this end, the electrostatic latent image developing device of the present invention includes a movable toner bearing member for transporting toner, such as developing roller, and a toner regulating blade which contacts at one surface with the toner bearing member so that the toner is regulated and then formed into a thin layer. The toner regulating blade has, in a surface confronting the toner bearing member, a bevelled portion which forms, together with the toner bearing member, a wedge-shaped space in a upstream side of the contact region of the blade and the toner bearing member with respect to the direction of movement of the toner bearing member.

Advantageously, the toner regulating blade also has chamfered portions in the bevelled portion at both sides thereof. Preferably, the bevelled portion forms an angle of 5° to 15° with an imaginary line extending from the surface of the blade.

According to the present invention, the bevelled portion together with the surface of toner bearing member forms a wedge-shaped space into which the toner transported by the toner bearing member enters. The toner is regulated in the wedge-shaped space such that a only specific amount of toner will pass through the contact region. While slipping through the contact region, the toner is electrically charged to a specified polarity. Also, the toner is formed into a thin toner-layer. Consequently, incremental portions moving past the contact region will bear a thin toner-layer composed of charged toner in an uniform density. Further, even though the blade is arranged more or less incorrectly, i.e., for example, a distance from a fixed portion to a free end portion thereof varies in every portion, the incremental portions moving past the contact region will bear a specified amount of toner.

It should be noted that blade allows a greater amount of toner to move past the contact region at both sides than a remaining region thereof. This is because a force of contact of the blade on both sides are lower than that of remaining region, i.e., central portion thereof.

To overcome this problem, the toner regulating blade also has chamfered portions in the bevelled portion at both sides thereof so that the wedge-shaped space formed in corresponding both regions are smaller than that of in the remaining region. Consequently, a smaller amount of toner is regulated and retained in the wedge-shaped space at each side, which ensures the entire length of the incremental portions moving past the contact region to retain a toner thin layer having a constant density.

BRIEF DESCRIPTION OF THE DRAWINGS

This and other objects and features of the present invention will become clear from the following description taken in conjunction with a preferred embodiment thereof with reference to the accompanying drawings throughout which like parts are designated by like reference numerals, and in which.

DETAILED DESCRIPTION OF THE INVENTION

Figure 1:
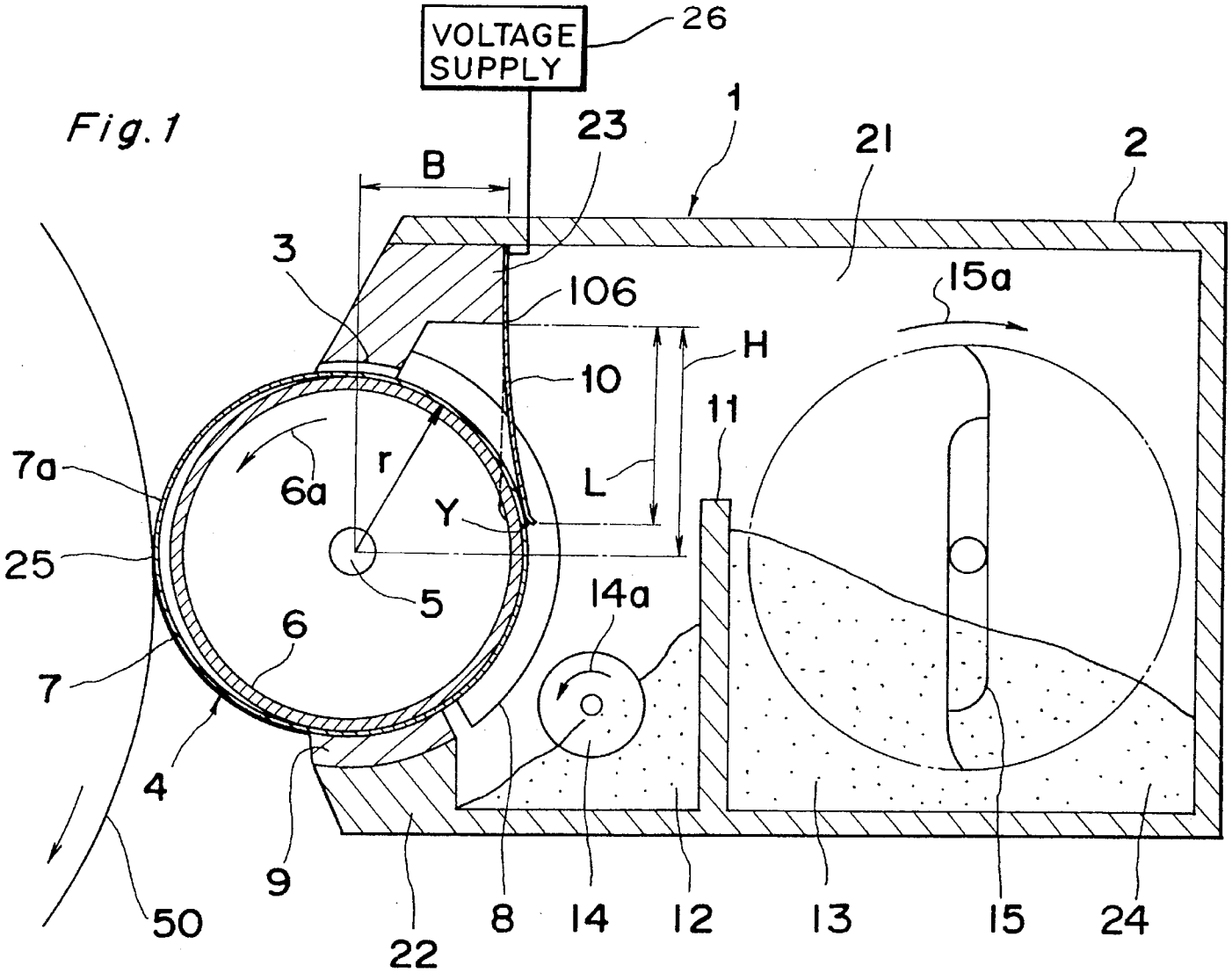
FIG. 1 is a transverse sectional view of an electrostatic latent image developing device of the present invention.

Referring now to the drawings, there is shown in FIG. 1 a partial transverse sectional view of an electrostatic latent image bearing member, for example, photoreceptor 50. The photoreceptor 50 comprises a cylindrical body or an endless belt having an photosensitive layer on its outer surface and is supported for rotation at a specific peripheral velocity by a suitable drive means such as motor. Disposed around the photoreceptor 50 are a plurality of image processing stations; a charge station for imparting electric charge to the photosensitive layer, an exposing station for projecting an image onto the surface of the layer to form an electrostatic latent image, a developing station for providing the electrostatic latent image with toner to develop the latent image into a visible toner powder image, a transfer station for depositing the visible powder image onto a record material such as paper, a cleaning station for removing residual toner from the photoreceptor 50, and an erasing station for removing residual toner in readiness for the next succeeding cycle of copy making.

A developing device generally indicated by reference numeral 1 is arranged at the developing station. The developing device 1 comprises a housing 2. The housing 2 has an opening 3 confronting the photoreceptor 50, in which a developing roller 4 is disposed. The developing roller 4 comprises a driven roller 6 which is supported for rotation about an axle 5 in one direction indicated by arrow *6a*, and a cylindrical sleeve which is made of a flexible and thin sheet of 0.16 mm in thickness and encloses the driven roller 6 therein. The sleeve 7 has an inner diameter of 24.53 mm which is greater than an outer diameter of 24.0 mm of the driven roller 6. Also, the sleeve 7 is, at its portion remote from the photoreceptor 50, brought into contact with an outer periphery of the driven roller 6 by a pair of biasing guides 8 supported on inner surfaces of side walls 21. Thus, when the driven roller 6 rotates, the sleeve 7 is also moved in the same direction at the same velocity by a friction generated between the driven roller 6 and the sleeve 7. In addition, the sleeve 7 forms, at its portion facing the photoreceptor 50, a sag *7a* which is spaced apart from the outer surface of the outer surface of the driven roller 6 but is in contact with the outer surface of the photoreceptor 50.

Disposed between a bottom portion of the housing 2 and the developing roller 4 is a seal member 9 made of, for example, foam rubber. This seal member 9 extends an entire length of the roller 4 so as to prevent toner accommodated in an interior of the housing 2 from leaking therefrom.

A blade 10 in the form of a strip-like plate having an approximate thickness of 0.1 mm is arranged almost vertically above the developing roller 4 in parallel relationship therewith. This blade is fixed at its upper portion thereof to a supporting member 23 of the housing, while the lower portion thereof has one surface thereof brought into contact with the outer surface of the sleeve 7. The blade is preferably made of metal such as stainless steel, synthetic resin, or rubber. A suitable coating such as polytetrafluoroethylene may be provided on the surface of the blade.

Interior space of the housing 2 is divided by a partition extending upwardly from the bottom of the housing 21 into two chambers; a buffer chamber 12 adjacent to the developing roller 4 and a toner supply chamber 13 remote from the developing roller 4. The buffer chamber 12 houses a paddle 14 mounted for rotation in the direction indicated by arrow *14a*, while the toner supply chamber 13 holds another paddle 15 mounted for rotation in the direction indicated by arrow *15a*.

A developer material, i.e., toner 24 is accommodated in the toner supply chamber 13. The toner 24 is conveyed from the supply chamber 13 to the buffer chamber 12 by the paddle 15 which rotates in the direction indicated by arrow *15a*. The toner 24 in the buffer chamber 12 is then supplied toward the outer surface of the sleeve 7 by the paddle 14 which rotates in the direction indicated by arrow *14a*. The sleeve 7 rotates in the direction indicated by arrow *6a* by the rotation of the driven roller 6 so that the toner 24 in the vicinity of the outer surface of the sleeve 7 is transported in the same direction. The toner is guided into the contact region of contact of the sleeve 7 with blade 10 and then is slipped through the region. At that time, the toner is electrically charged to a specific polarity by a contact with the blade 10. As a result, incremental portions of outer periphery of the sleeve 7 moving past the contact region retain thereon a thin toner-layer having electricity. The toner is then transported in the direction indicated by arrow *6a* successively into a developing region 25 where the sleeve 7 contacts the photoreceptor 50 so that the electrostatic latent image formed on the photoreceptor 50 is developed into a visible powder image. The toner not deposited on the photoreceptor at the developing region 25, but remaining on the sleeve 7 is transported through a contact region of contact of the sleeve 7 with the seal member 9 to the buffer chamber 12.

Figure 2:
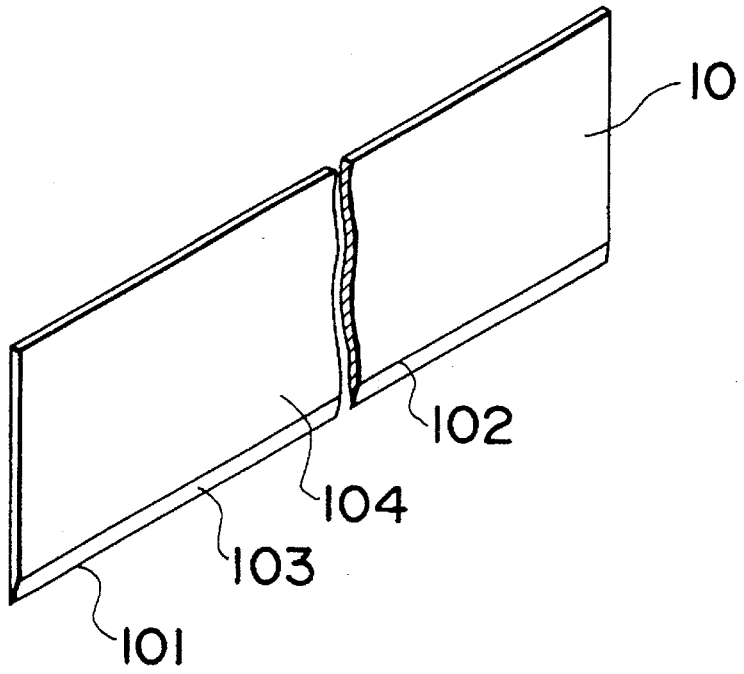
FIG. 2 is a perspective view of a toner regulating blade of the present invention.
Figure 3:
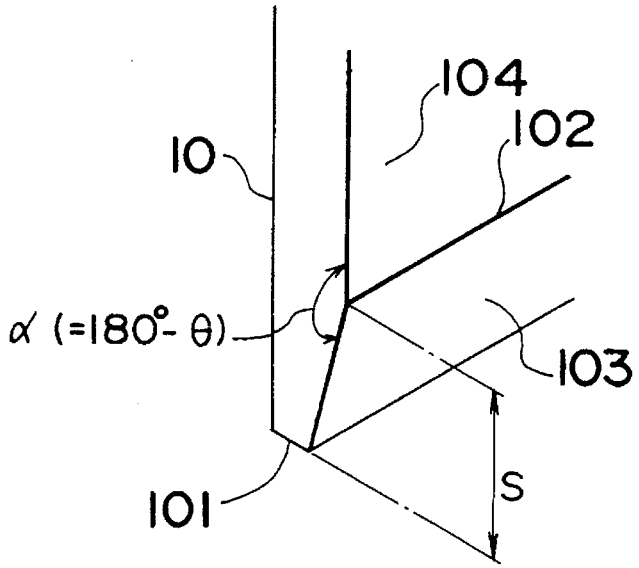
FIG. 3 is an enlarged fragmentary perspective view of the toner regulating blade shown in FIG. 2.

A structural feature of the blade 10 will now be discussed in detail. As shown in detail in FIGS. 2 and 3, the blade 10 has a bevelled portion 103 at its free end portion on one surface 104 confronting the sleeve 7. The bevelled portion 103 is formed by straightly cutting off a corresponding portion of the blade 10 so that a thickness of the blade 10 decreases gradually toward an edge portion 101 from a bent portion 102 spaced a specified distance therefrom. The bevelled portion 103 thus formed together with the surface 104 makes an obtuse angle of (180°-θ) inside the blade 10. It is preferable that, if the bevelled portion 103 is formed by machine cutting, care must be taken to avoid formation of any small undulation on the surface of the bevelled portion 103.

Figure 4:
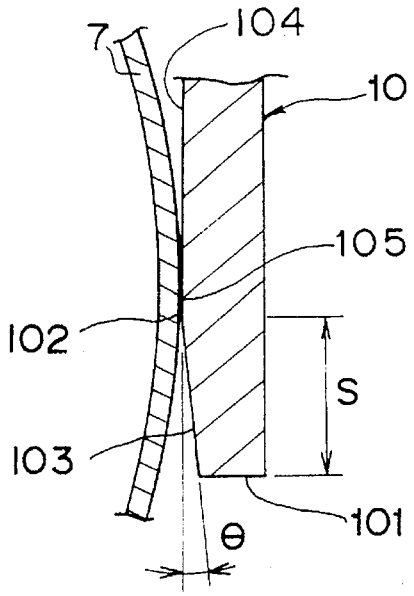
FIG. 4 is a enlarged transverse sectional view showing part of a developing sleeve and a free end portion of the toner regulating blade which contacts with the developing sleeve.

The blade is so arranged in the housing 2 that, before installation of the developing roller 4, the blade 10 extends along a straight dotted line as shown in FIG. 1, and once the developing roller has been installed in the housing, its flat surface 104 in the vicinity of the bent portion 102 contacts the outer curved surface of the sleeve 7 and bends (see FIGS. 1 and 4). A force of contact of the blade 10 against the sleeve 7 is preferably set to be about 9.0 g/mm.

Figure 5:
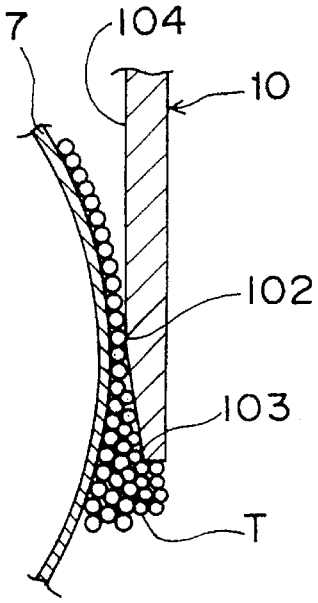
FIG. 5 shows toner regulated by the toner regulating blade in an enlarged scale.

Accordingly, as shown in FIG. 5, the toner transported by the movement of the sleeve 7 is regulated to enter a wedge-shaped space formed by the beveled surface 7 and the outer surface of the sleeve 7, and then a specific amount of toner is accommodated in the wedge-shaped space. The volume of the wedge-shaped space depends upon the length of the bevelled portion 103, which allows a specific amount of toner to be transported into a region 105 where the blade 10 contacts the sleeve 7. As a result, a nearly constant amount of toner is guided into the contact region 105, and incremental portions of the outer surface of the sleeve 7 will bear thereon a substantially constant amount of toner.

Figure 6:
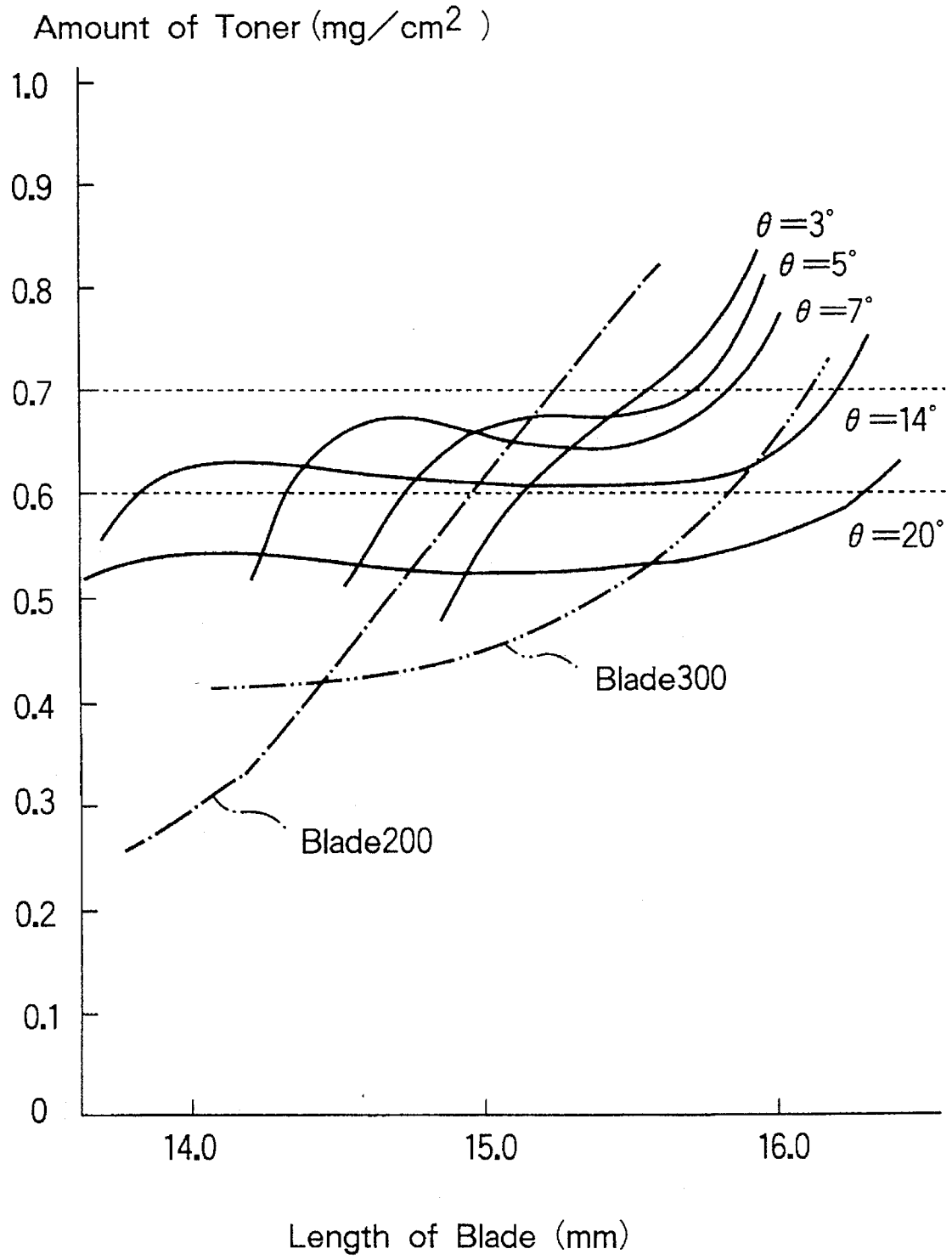
FIG. 6 is a graph showing relationship between a length of the toner regulating blade and an amount of toner retained on the developing sleeve moving past a region where the toner regulating blade contacts with the developing sleeve; blade of other type.

To clarify an allowance of the length of the projected portion in the blade, i.e., the length L from a fixed portion 106 to the edge 101 of the blade 10 as shown in FIG. 1, experiments were conducted. In these experiments, an amount of toner retained on the surface of the sleeve are measured with respect to five blades, whose angles θ are set to 3°, 5°, 7°, 14°, and respectively, with the distance S from the edge 101 to the bent portion 102 being 0.3 mm, a radius r of the driven roller 6 being 12 mm, the horizontal distance from a center of the driven roller 6 to the fixed portion 106 being 18.7 mm, and the vertical distance from a center of the driven roller 6 to the fixed portion 106 being 7.3 mm. The result is shown in FIG. 6. Further, based on characteristics curves illustrated in the drawing, for each blade except one, maximum and minimum lengths L(MAX) and L(MIN) required to provide the surface of the developing sleeve moving past the contact region 105 with a specific amount of toner from 0.6 to 0.7 mg/cm$^2$, which is needed for developing the electrostatic latent image on the photoreceptor 50 into an image having a suitable density, and the allowance or difference L(DF) between L(MAX) and L(MIN) are shown in Table 1.

TABLE 1

| BLADE NO. | θ(°) | L(MAX) (mm) | L(MIN) (mm) | L(DF) (mm) |
|---|---|---|---|---|
| 1 | 3 | 15.1 | 15.5 | 0.4 |
| 2 | 5 | 14.7 | 15.7 | 1.0 |
| 3 | 7 | 14.3 | 15.8 | 1.5 |
| 4 | 14 | 13.7 | 16.2 | 2.5 |

Figure 7:
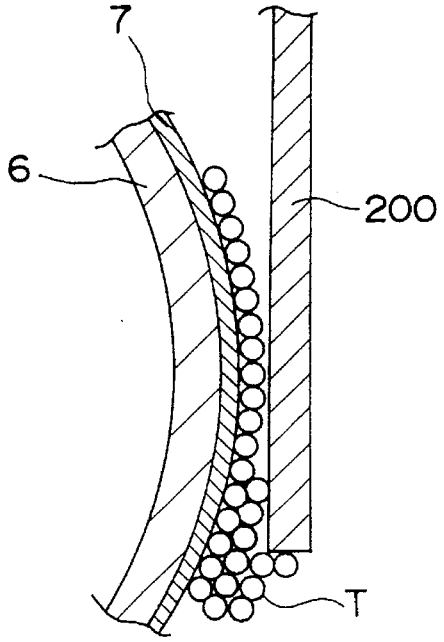
Fig. 7 (PRIOR ART)
FIG. 7 shows toner regulated by a toner regulating blade of other type.
Figure 8:
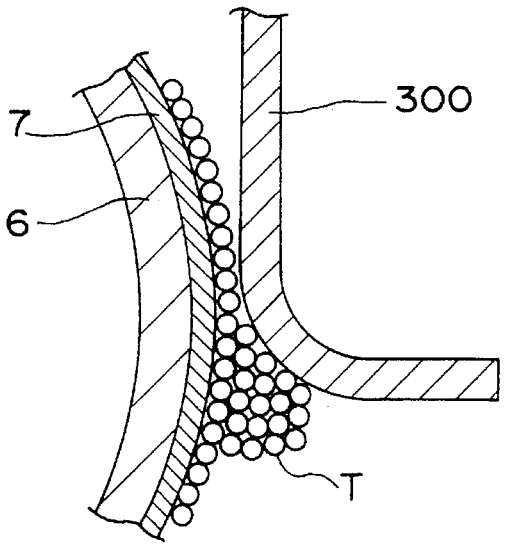
Fig. 8 (PRIOR ART)
FIG. 8 shows toner regulated by a toner regulating blade of another type.

For comparison purpose, using two blades, that is, a straight blade having no transformation as shown by reference numeral 200 in FIG. 7, and a blade curved at its free end portion at approximately right angle as shown by reference numeral 300 in FIG. 8, experiments were conducted to estimate amounts of toner retained on the surface of the sleeve with the same parameters as those in the previous experiments. The results are also shown in FIG. 6. The maximum and minimum lengths L(MAX), L(MIN) required to provide the surface of the developing sleeve moving past the contact region 105 with the specific amount of toner from 0.6 to 0.7 mg/cm$^2$ and the allowance or difference L(DF) thereof are shown in Table 2.

TABLE 2

| BLADE | L(MIN) (mm) | L(MAX) (mm) | L(DF) (mm) |
|---|---|---|---|
| 200 | 15.0 | 15.3 | 0.3 |
| 300 | 15.8 | 16.1 | 0.3 |

As can be seen from FIG. 6 and Table 1, the angle θ of the bevelled portion in the blade must be formed from 4° to 15°. Also, the allowance L(DF) in setting the blade of the present invention for providing the sleeve with the specific amount of toner (0.6–0.7 mg/cm$^2$ ) is relatively large, while that in setting the blade 200 or 300 is small. This means that not so much time is required for setting the blade of the present invention.

Another experiment was performed with the same parameters in the first experiment except that the length S of 0.4 mm, and the angle θ of the bevelled portion of 7°. As a result, the sleeve could stably retain toner of 0.7–0.8 mg/cm$^2$.

A second embodiment of the blade will be discussed below. Generally, when a blade in a form of a plate contacts the surface of the sleeve, at both sides thereof, it loses its force of contact against the sleeve, that is an ability for regulating toner. Therefore, the sleeve moving past the contact region retains at both sides thereof a greater amount of toner than a remaining region or a central region. As a result, an image developed has a higher density in the corresponding side regions than that at the central region.

Figure 9:
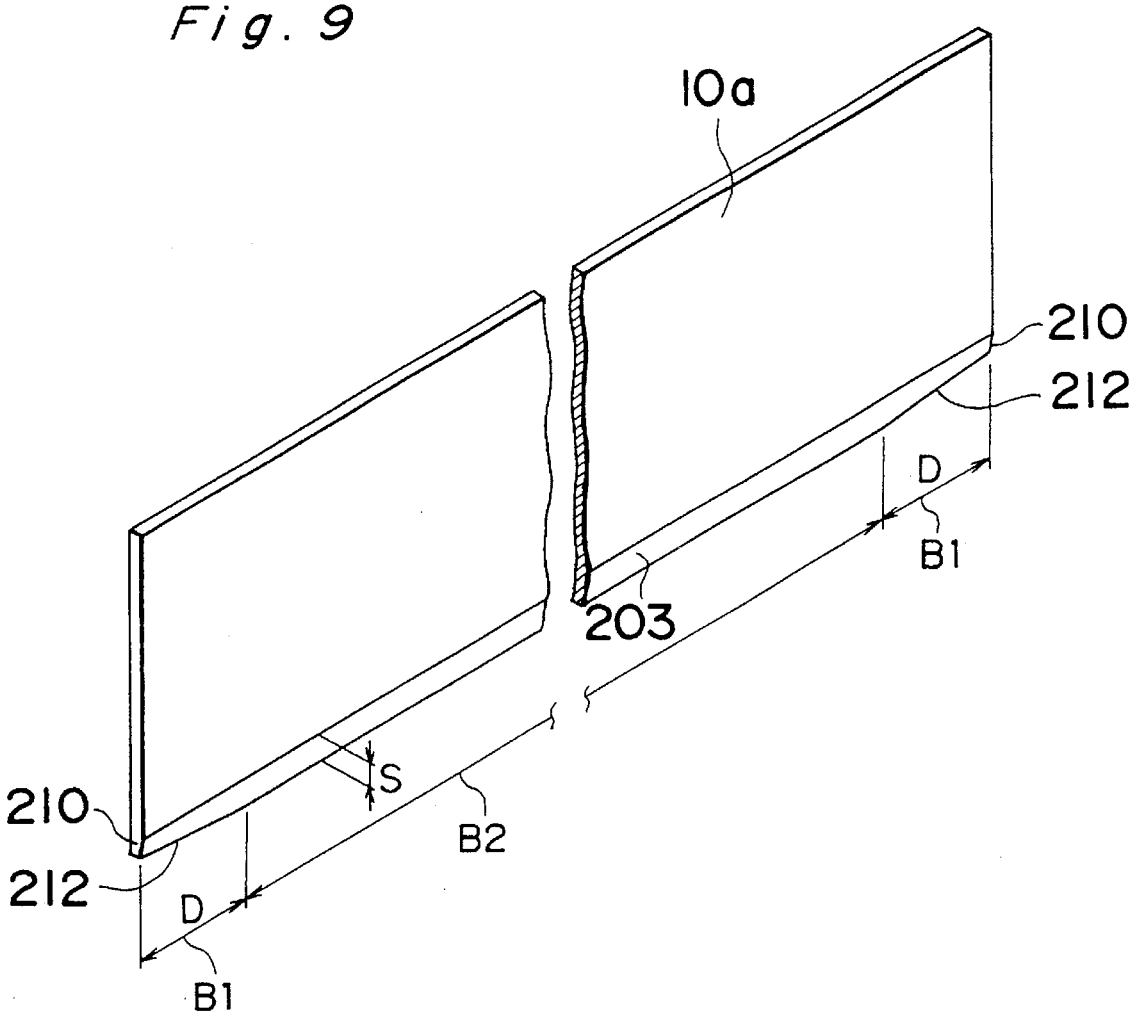
FIG. 9 is a perspective view of a toner regulating blade of the second embodiment of the present invention.

After due consideration of this point, in order to make the sleeve support a constant amount of toner along the entire length thereof, the blade **10*a* further has chamfered portions 212 at both sides of the bevelled portion 203 as shown in FIG. 9. Each chamfered portion 212 is formed by cutting off a corner in the region B1 extending from side edge 210 to a position spaced a specific distance D apart therefrom, such that, in each region B1, the wedge-shaped space becomes smaller as it advances towards the side edge 210. This result in a decrease of an ability for feeding toner into the contact region, and will offset the excess feeding of the toner. Consequently, the sleeve will retain a constant amount of toner along the entire length thereof, that is, it supports a constant amount of toner on each side region B1 and the remaining central region B2** therebetween.

Figure 10:
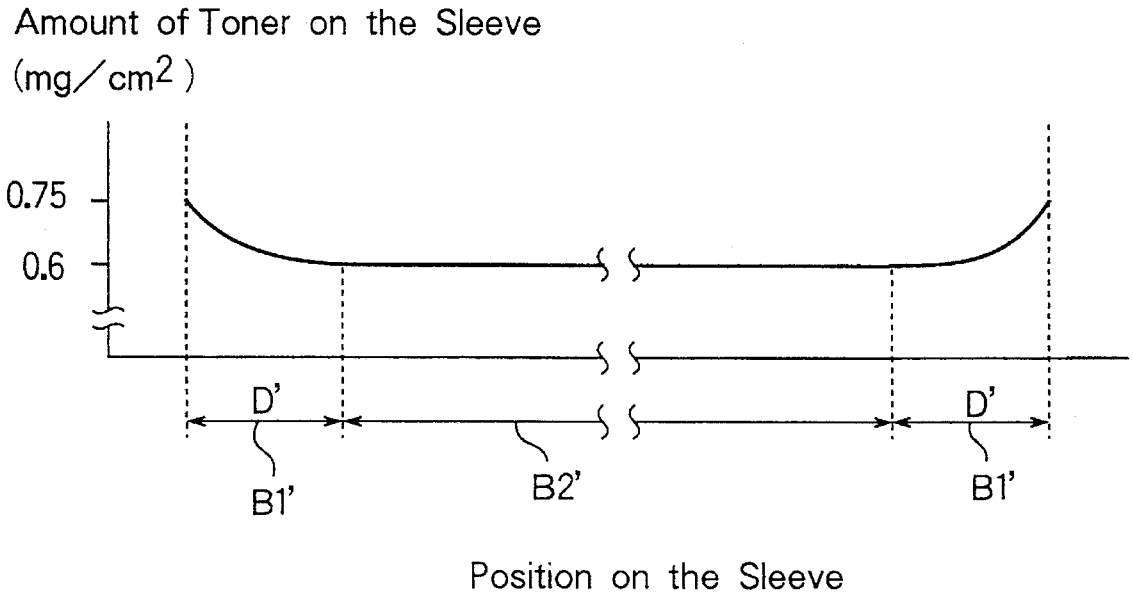
FIG. 10 shows a distribution of an amount of toner retained on the developing sleeve moving past the contact region.

To demonstrate the effect of the second embodiment of the present invention, several experiments were conducted. In the first experiment, using a stainless steel blade without having any chamfered portions, the amount of toner supported on the sleeve moving past the contact region is measured. The blade used was 0.1 mm in thickness, 215 mm in width and the length S of the bevelled portion was 0.2 mm with the angle θ being 11°. The result is shown in FIG. 10. This shows that, in the region corresponding to the width of the blade, the sleeve 7 supports a constant amount of toner of 0.6 mg/cm$^2$ on a central region B2', whereas, in side regions B1' extending from each side edge to a position spaced D' of 20 mm therefrom and locating outside the central region B2', the amounts of toner increase markedly towards respective side edges on the basis of the decrease of the contact force of the blade against the sleeve, and then toner having an amount of 0.75 mg/cm$^2$ has passed at the edge portion of the sleeve.

Figure 11:
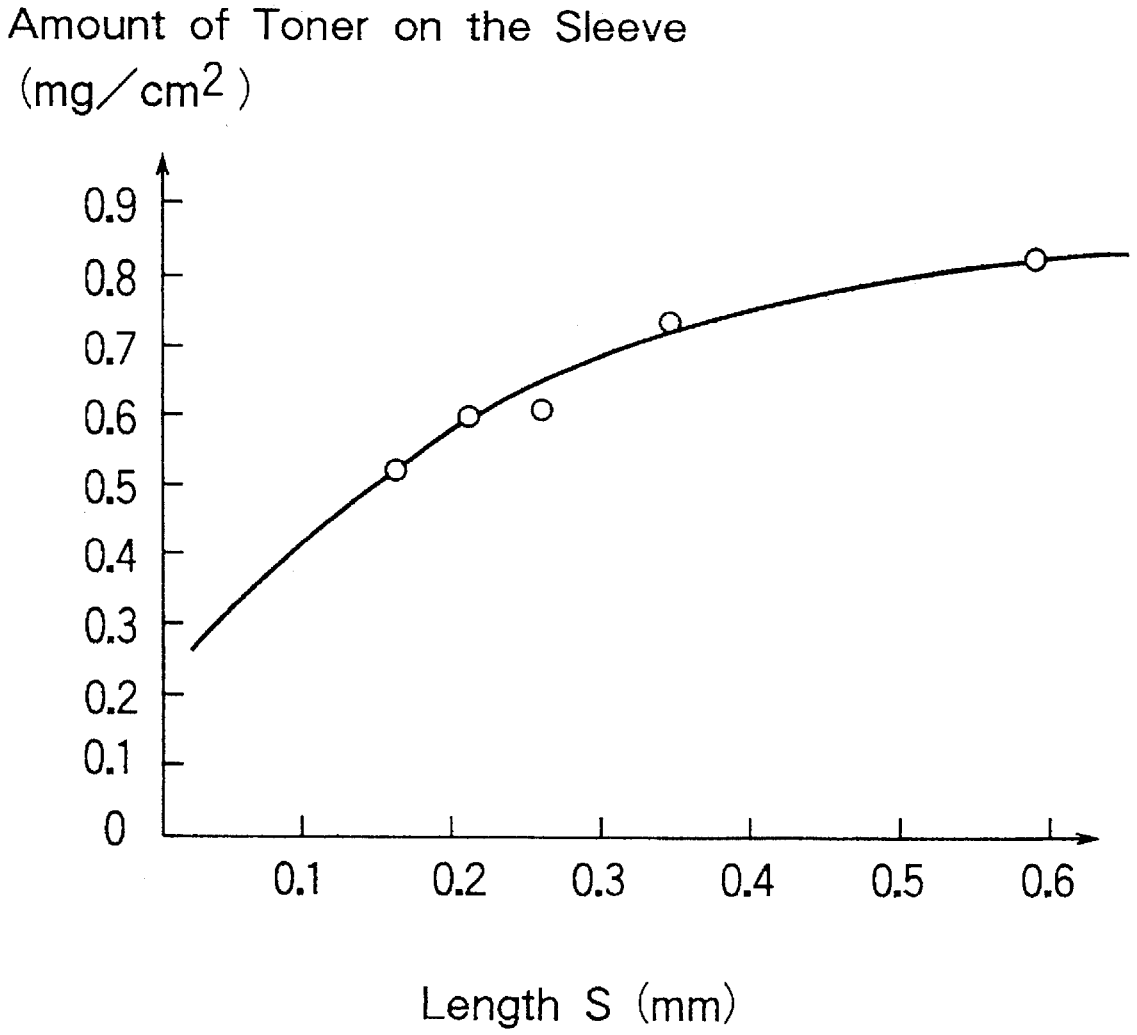
FIG. 11 is a graph showing a relationship between a length of a bevelled portion and an amount of toner retained on the developing sleeve moving past the contact region.

In the second embodiment, amounts of toner supported on the sleeve 7 were measured for each blade whose length of the bevelled portion is different from others. The result is shown in FIG. 11. As is shown in the graph, the amount of toner supported on the sleeve 7 increases with an increase of the length of the bevelled portion 203. Therefore, as for the blade used in the first experiment, if the length of the bevelled portion 203 in the blade 10 is gradually reduced so as to be chamfered in both side regions from the side edge to a point spaced the distance D of 20 mm therefrom towards the center of the blade, an area of the wedge-shaped space in the side regions B1' corresponding to the chamfered portion is smaller than that of the central region B2', which results in a decrease in amount of toner guided into the blade contact region. Consequently, this offsets the possibility that an excess amount of toner is transported into the blade contact region based on the lack of contact force in the side regions, which ensures the sleeve to support a constant amount of toner along the entire length thereof.

Figure 12:
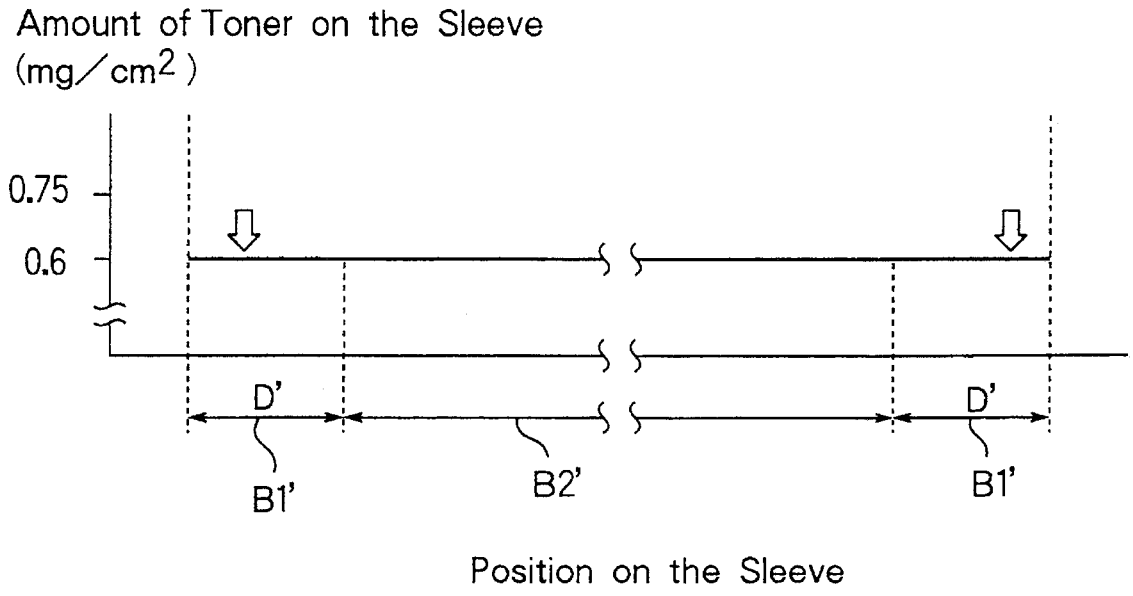
FIG. 12 shows a distribution of the amount of toner retained on the developing sleeve moving past the contact region in case that the toner regulating plate of the second embodiment is used.

Based on the results of the first and second experiments and considerations thereof, the amounts of toner supported on the sleeve were measured using an improved blade in which the bevelled portion is designed as follows; the length S thereof in the central region B2 being set to be 0.2 mm, and the length of the in each side region B1 from side edge to a position spaced 20 mm apart from the edge 210 corresponding to the side region B1' in the sleeve 7 being set to be 0.13 mm. Other parameters such as the thickness of the blade and the bevelled angle θ of the bevelled portion 203 are designed as 0.1 mm, 11°, respectively, as in the blade used in the above experiments. The result is shown in FIG. 12. As shown in the drawing, the amount of toner supported on each side region decreases to 0.6 mg/cm$^2$ and this constant amount of toner is also retained on the central region B2' of the sleeve.

Figure 13:
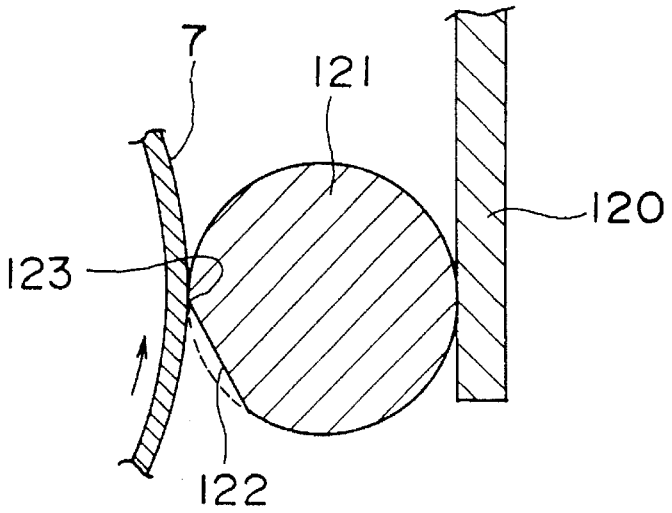
FIG. 13 is a transverse sectional view of a toner regulating blade of the third embodiment of the present invention.

FIG. 13 shows another embodiment of the blade, in which the blade comprises a plane plate 120 and a round rod 121 fixed on a surface thereof, and the rod 121 is formed with a bevelled portion 122 in the outer surface thereof by cutting the corresponding portion. The blade is so arranged adjacent to the sleeve 7 that one edge portion of the bevelled portion 122 or the vicinity thereof contacts with the outer surface of the sleeve 7. The bevelled portion may be formed in any other method, not limited by the machine cutting.

Figure 14:
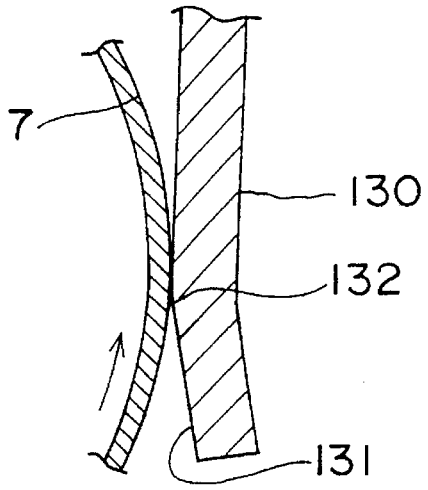
FIG. 14 is a transverse sectional view of a toner regulating blade of the fourth embodiment of the present invention.

FIG. 14 shows a different embodiment of the blade 130, in which the bevelled portion 131 is formed by bending the blade 130. This blade is so arranged adjacent to the sleeve 7 that a surface portion thereof near a bent portion 132, remote from the edge of the blade, contacts the sleeve 7.

Further, if the blade is made of electrically conductive material, the blade and/or the sleeve may be applied with a specific voltage from a voltage supply 26.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An electrostatic latent image developing device, comprising:

a rotatable developing roller for providing an electrostatic latent image formed on a photoreceptor with a toner so as to develop the latent image into a visual image; and a toner regulating blade having a surface which contacts the developing roller so that the toner is regulated and then formed into a thin layer;

wherein the toner regulating blade has, extending from said surface a bevelled portion which forms, together with an outer surface of the developing roller, a wedge shaped space in an upstream side of a contact region of the blade and the developing roller with respect to a direction of a movement of the developing roller, and the bevelled portion forms an angle of 5° to 15° with an imaginary line extending from said surface of the blade.

2. An electrostatic latent image developing device as claimed in claim 1, wherein the toner regulating blade also has chamfered portions in the bevelled portion at both sides thereof.

3. The electrostatic latent image developing device as claimed in claim 1, wherein the beveled surface of the blade is substantially planar.

4. An electrostatic latent image developing device, comprising:

a movable toner bearing member for bearing thereon toner; and a toner regulating blade having a surface which contacts the toner bearing member so that the toner is regulated and then formed into a thin layer;

wherein the toner regulating blade has, extending from said surface a bevelled portion which forms, together with the toner bearing member, a wedge shaped space in an upstream side of a contact region of the blade and the toner bearing member with respect to a direction of a movement of the toner bearing member, and the bevelled portion forms an angle of 5° to 15° with an imaginary line extending from said surface of the blade.

5. An electrostatic latent image developing device as claimed in claim 4, wherein the toner regulating blade also has chamfered portions in the bevelled portion at both sides thereof.

6. The electrostatic latent image developing device as claimed in claim 4, wherein the beveled surface of the blade is substantially planar.

7. A toner regulating blade which is so arranged in an electrostatic latent image developing device as to contact with a toner bearing member to form thereon a toner thin layer, including;

a bevelled portion, in a surface of the blade confornting the toner bearing member, for forming, together with the toner bearing member, a wedge shaped space in an upstream side of a contact region of the blade and the toner bearing member with respect to a direction of a movement of the toner bearing member, and the bevelled portion forms an angle of 5° to 15° with an imaginary line extending from said surface of the blade.

8. A toner regulating blade as claimed in claim 7, wherein the toner regulating blade also has chamfered portions in the bevelled portion at both sides thereof.

9. The toner regulating blade as claimed in claim 7, wherein the beveled surface of the blade is substantially planar.

10. An electrostatic latent image developing device, comprising:

a housing accommodating a toner and having an opening confronting an electrostatic latent image bearing member;

a rotatable developing roller disposed in the opening of said housing;

a toner regulating blade provided on said housing and having a bevelled portion at its free end portion on one surface contacting the developing roller, said bevelled portion being formed by straightly cutting off a corresponding portion of the blade so that a thickness of the blade decreases gradually toward an edge portion and an angle formed between the bevelled portion and an imaginary line extending from said surface of the blade is 5° to 15°.

11. An electrostatic latent image developing device as claimed in claim 10, wherein a length of the bevelled portion at two side regions of the blade is shorter than a length of the bevelled portion in a central region of the blade.

12. An electrostatic latent image developing device as claimed in claim 11, wherein the length of the bevelled portion is gradually reduced so as to be chamfered in said two side regions.

13. An electrostatic latent image developing device as claimed in claim 10, wherein said blade is made of electrically conductive material to which a voltage is applied.

14. An electrostatic latent image developing device as claimed in claim 10, wherein a portion between a fixed portion and the bevelled portion of the blade contacts with the developing roller.

15. The electrostatic latent image developing device as claimed in claim 10, wherein the beveled surface of the blade is substantially planar.

* * * * *